US008955327B2

(12) United States Patent
Barker et al.

(10) Patent No.: US 8,955,327 B2
(45) Date of Patent: Feb. 17, 2015

(54) MICROMIXER HEAT SHIELD

(75) Inventors: Carl Robert Barker, Greenville, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 803 days.

(21) Appl. No.: 13/210,478

(22) Filed: Aug. 16, 2011

(65) Prior Publication Data

US 2013/0042625 A1 Feb. 21, 2013

(51) Int. Cl.

| | |
|---|---|
| ***F02C 7/26*** | (2006.01) |
| ***F23R 3/48*** | (2006.01) |
| ***F23R 3/28*** | (2006.01) |

(52) U.S. Cl.

CPC . *F23R 3/286* (2013.01); *F23R 3/48* (2013.01); *F23R 2900/00002* (2013.01)

USPC ..... 60/738; 60/737; 60/778; 239/397.5

(58) Field of Classification Search

CPC ..... F23R 3/08; F23R 3/28; F23R 3/286; F23R 3/46; F23R 3/48; F23R 2900/00002

USPC ..... 60/737–748, 772, 776, 778; 239/397.5; 431/8, 354

See application file for complete search history.

(56) References Cited

U.S. PATENT DOCUMENTS

| | | | | |
|---|---|---|---|---|
| 4,313,400 | A | 2/1982 | Walker et al. | |
| 4,351,392 | A | 9/1982 | Stockman | |
| 5,492,168 | A | 2/1996 | Hemsath | |
| 8,157,189 | B2 * | 4/2012 | Johnson et al. | 239/132.5 |
| 8,181,891 | B2 * | 5/2012 | Ziminsky et al. | 239/430 |
| 8,276,385 | B2 * | 10/2012 | Zuo et al. | 60/737 |
| 2009/0297335 | A1 | 12/2009 | Karafillis | |
| 2010/0031662 | A1 * | 2/2010 | Zuo | 60/740 |
| 2010/0186413 | A1 * | 7/2010 | Lacy et al. | 60/740 |
| 2010/0252652 | A1 * | 10/2010 | Johnson et al. | 239/132 |
| 2011/0057056 | A1 * | 3/2011 | Ziminsky et al. | 239/398 |
| 2011/0073684 | A1 * | 3/2011 | Johnson et al. | 239/553.5 |
| 2011/0083439 | A1 * | 4/2011 | Zuo et al. | 60/737 |

FOREIGN PATENT DOCUMENTS

| | | | |
|---|---|---|---|
| EP | 2055961 | A1 | 5/2009 |

* cited by examiner

*Primary Examiner* — J. Gregory Pickett

(74) *Attorney, Agent, or Firm* — Armstrong Teasdale LLP

(57) ABSTRACT

A combustor includes a combustor wall defining a combustion zone and a fuel nozzle. The fuel nozzle includes a forward face, an aft face downstream from the forward face and adjacent to the combustion zone, a plurality of mixing tubes extending between the forward face and the aft face, an outer sleeve positioned radially outward of the plurality of mixing tubes, a heat shield positioned radially inward of the outer sleeve, and a baffle plate between the forward face and the aft face. At least one of the plurality of mixing tubes includes a sidewall that includes an injection opening defined therethrough. The baffle plate is oriented to channel fuel between the plurality of mixing tubes and between the baffle plate and the aft face prior to the fuel being channeled through the injection opening.

15 Claims, 2 Drawing Sheets

MICROMIXER HEAT SHIELD

BACKGROUND

The present disclosure relates generally to a turbine system and more particularly to a micromixer fuel nozzle that may be used with a turbine system.

Some known turbine systems include at least one combustor assembly that mixes compressed air with fuel and ignites the fuel-air mixture to generate combustion gases within a combustion zone defined in the combustor assembly. More specifically, at least some known combustor assemblies use a micromixer that includes an outer sleeve that is oriented to channel air and/or fuel towards the combustion zone and an aft face that is positioned adjacent to the combustion zone. As a result, the aft face is exposed to the relatively high temperatures generated within the combustion zone.

At least some known micromixers channel air and/or fuel towards the combustion zone at a relatively high velocity. Channeling the air and/or fuel at such a velocity ensures that energy losses within the air and/or fuel are minimized, but results in a forced convective cooling of the outer sleeve. As such, thermal gradients and/or thermal stresses may develop within at least some known micromixers. Over cycles, such thermal gradients and/or thermal stresses may limit the useful life of portions of the micromixer and/or may lead to a premature failure of such components.

BRIEF DESCRIPTION

In one aspect, a method is provided for preparing a turbine engine for operation. The method includes channeling fuel between a baffle plate and an aft face of a fuel nozzle. The baffle plate is between a forward face and the aft face of the fuel nozzle. The fuel is channeled toward a heat shield and between a plurality of mixing tubes extending between the forward face and the aft face. The fuel is channeled through an injection opening defined in a sidewall forming at least one of the plurality of mixing tubes.

In another aspect, a fuel nozzle is provided. The fuel nozzle includes a forward face, an aft face downstream from the forward face, a plurality of mixing tubes extending between the forward face and the aft face, an outer sleeve positioned radially outward of the plurality of mixing tubes, a heat shield positioned radially inward of the outer sleeve, and a baffle plate between the forward face and the aft face. At least one of the plurality of mixing tubes includes a sidewall that includes an injection opening defined therethrough. The baffle plate is oriented to channel fuel between the plurality of mixing tubes and between the baffle plate and the aft face prior to the fuel being channeled through the injection opening.

In yet another aspect, a combustor is provided. The combustor includes a combustor wall defining a combustion zone and a fuel nozzle. The fuel nozzle includes a forward face, an aft face downstream from the forward face and adjacent to the combustion zone, a plurality of mixing tubes extending between the forward face and the aft face, an outer sleeve positioned radially outward of the plurality of mixing tubes, a heat shield positioned radially inward of the outer sleeve, and a baffle plate between the forward face and the aft face. At least one of the plurality of mixing tubes includes a sidewall that includes an injection opening defined therethrough. The baffle plate is oriented to channel fuel between the plurality of mixing tubes and between the baffle plate and the aft face prior to the fuel being channeled through the injection opening.

The features, functions, and advantages that have been discussed can be achieved independently in various embodiments of the present invention or may be combined in yet other embodiments further details of which can be seen with reference to the following description and drawings.

DETAILED DESCRIPTION

The subject matter described herein relates generally to turbine systems and more particularly to a micromixer that may be used with a turbine system. In one embodiment, a fuel nozzle includes a forward face, an aft face downstream from the forward face, a plurality of mixing tubes that extend between the forward and aft faces, an outer sleeve positioned radially outward of the plurality of mixing tubes, a heat shield positioned radially inward of the outer sleeve, and a baffle plate positioned between the forward and aft faces. In such an embodiment, the fuel nozzle channels fuel downstream through a center supply tube towards a space defined between the baffle plate and the aft face. The fuel is channeled radially outward through the space defined between the baffle plate and the aft face, and then the fuel is channeled upstream towards an injection opening defined in a mixing tube. The fuel is channeled through the injection opening, and then the fuel is mixed with air channeled through the mixing tube. The air-fuel mixture is channeled through the mixing tube towards a combustion zone defined in a combustor. As such, the baffle plate and/or the heat shield regulate fuel and/or air flow within the fuel nozzle to facilitate reducing thermal stresses that may be generated within the fuel nozzle.

As used herein, the terms "axial" and "axially" refer to directions and orientations extending substantially parallel to a longitudinal axis of a combustor. The terms "radial" and "radially" as used in this disclosure refer to directions and orientations extending substantially perpendicular to the longitudinal axis of the combustor. As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
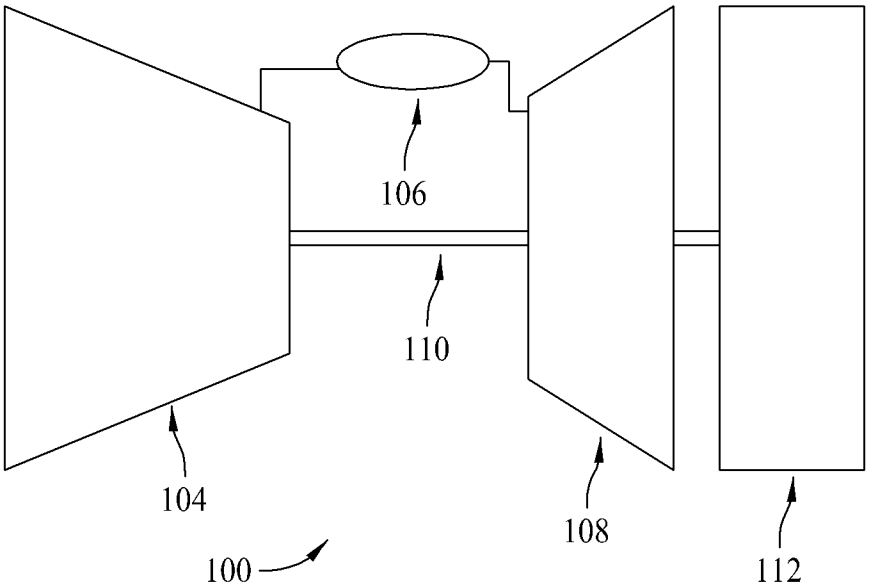
FIG. 1 is a schematic illustration of an exemplary turbine system.

FIG. 1 is a schematic illustration of an exemplary turbine system 100. In the exemplary embodiment, turbine system 100 includes, coupled in a serial flow arrangement, a compressor 104, a combustor assembly 106, and a turbine 108 that is rotatably coupled to compressor 104 via a rotor shaft 110. In one embodiment, turbine system 100 is a GE 7FB gas turbine commercially available from General Electric Company headquartered in Schenectady, N.Y.

During operation, in the exemplary embodiment, ambient air is channeled through an air inlet (not shown) towards compressor 104. The ambient air is compressed by compressor 104 prior to being channeled towards combustor assembly. In the exemplary embodiment, compressed air within combustor assembly 106 is mixed with fuel, and the resulting fuel-air mixture is ignited within combustor assembly 106 or, more specifically, a combustion zone (not shown in FIG. 1) to generate combustion gases that are channeled towards turbine 108. In the exemplary embodiment, turbine 108 extracts rotational energy from the combustion gases and rotates rotor shaft 110 to drive compressor 104. Moreover, in the exemplary embodiment, turbine system 100 drives a load 112, such as a generator, coupled to rotor shaft 110. In the exemplary embodiment, load 112 is downstream of turbine system 100. Alternatively, load 112 may be positioned upstream of turbine system 100.

Figure 2:
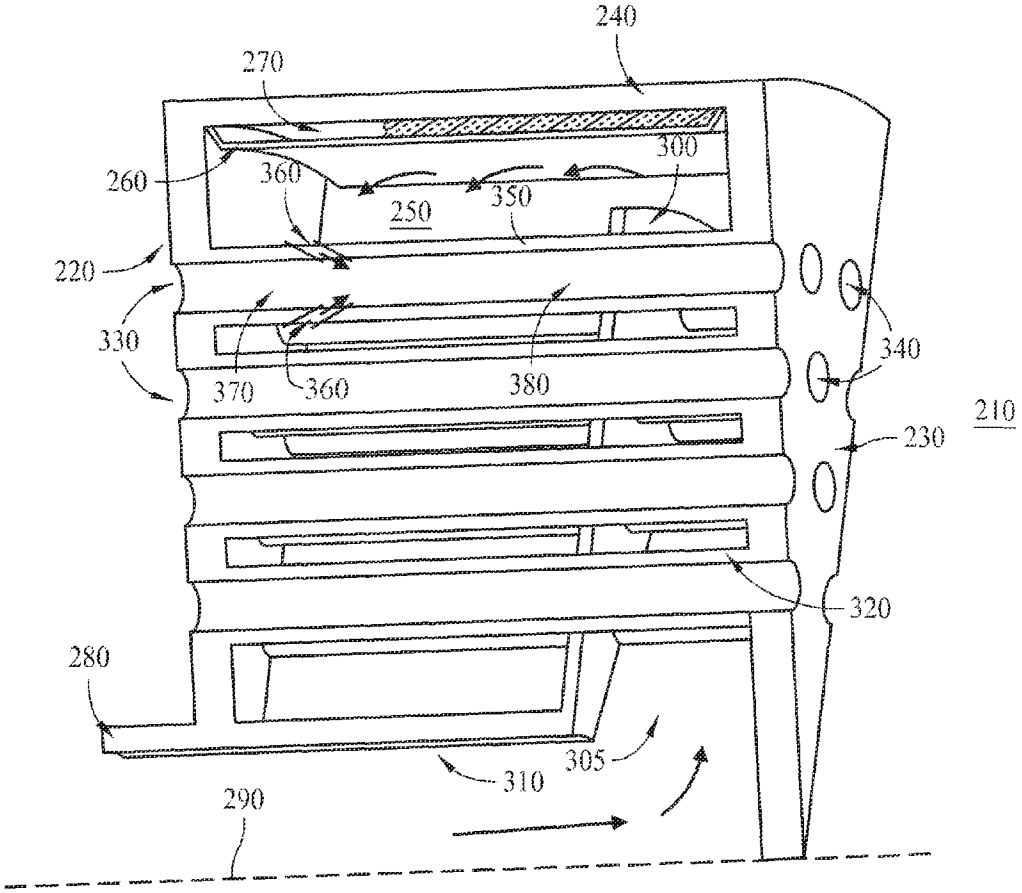
FIG. 2 is a perspective view of a portion of a micromixer that may be used with the turbine system shown in FIG. 1.

FIG. 2 is a perspective view of a portion of a micromixer or, more broadly, a fuel nozzle 200 that may be used with combustor assembly 106 to mix compressed air with fuel to create a combustible air-fuel mixture. In the exemplary embodiment, fuel nozzle 200 is positioned upstream from a combustion zone 210 defined within combustor assembly 106 to enable the air-fuel mixture to be channeled through fuel nozzle 200 and ignited within combustion zone 210.

More specifically, in the exemplary embodiment, fuel nozzle 200 includes a forward face 220, an aft face 230 that is positioned axially downstream from forward face 220, and an outer sleeve 240 that extends between forward and aft faces 220 and 230 such that a cavity 250 is defined therein.

In the exemplary embodiment, fuel nozzle 200 includes a heat shield 260 that is positioned radially inward of outer sleeve 240. In the exemplary embodiment, heat shield 260 extends along an inner surface of outer sleeve 240 to facilitate reducing a convection cooling of outer sleeve 240. Heat shield 260 may be fabricated from any material such as, without limitation, a ceramic that enables heat shield 260 to function as described herein.

In the exemplary embodiment, heat shield 260 defines an annular gap 270 therebetween. In the exemplary embodiment, gap 270 facilitates further reducing a heat transfer between outer sleeve 240 and the fuel and/or air channeled through fuel nozzle 200. As such, gap 270 insulates outer sleeve 240 from fuel and/or air being channeled through fuel nozzle 200. Alternatively, heat shield 260 may be any structure, feature, and/or element that enables fuel nozzle 200 to function as described herein. For example, in an alternative embodiment, heat shield 260 may be a thermal barrier coating applied to an inner surface of outer sleeve 240. Any insulating mechanism may be positioned and/or disposed between heat shield 260 and outer sleeve 240 that enables heat shield 260 to function as described herein.

In the exemplary embodiment, a center supply tube 280 extends through forward face 220. Tube 280 is oriented to channel fuel downstream towards aft face 230. In the exemplary embodiment, center supply tube 280 extends generally axially through cavity 250 between forward and aft faces 220 and 230. More specifically, in the exemplary embodiment, center supply tube 280 is aligned substantially coaxially with fuel nozzle 200 and extends substantially along a longitudinal axis 290 of fuel nozzle 200.

In the exemplary embodiment, a baffle plate 300 is positioned between forward and aft faces 220 and 230. More specifically, in the exemplary embodiment, baffle plate 300 extends generally radially outward from a downstream end 310 of center supply tube 280. Baffle plate 300 is oriented to channel fuel from center supply tube 280 and radially outward through a space 305 defined between baffle plate 300 and aft face 230. More specifically, in the exemplary embodiment, fuel is channeled radially outward through space 305 between adjacent mixing tubes 320 towards heat shield 260 and outer sleeve 240.

In the exemplary embodiment, each mixing tube 320 extends generally axially through cavity 250 between forward face 220 and aft face 230. More specifically, in the exemplary embodiment, each mixing tube 320 includes an upstream opening 330 that is defined in forward face 220 and a downstream opening 340 that is defined in aft face 230. Tubes 320 are oriented to channel air and/or fuel axially towards combustion zone 210. Moreover, in the exemplary embodiment, each mixing tube 320 extends through baffle plate 300 such that mixing tubes 320 extend a distance upstream and downstream from baffle plate 300. Downstream from baffle plate 300, fuel is channeled radially outward from tube 280 towards heat shield 260 and/or outer sleeve 240, and upstream of baffle plate 300, fuel is channeled radially inward towards mixing tubes 320.

In the exemplary embodiment, each mixing tube 320 includes a sidewall 350 that includes an injection opening 360 defined therein. In one embodiment, sidewall 350 includes a plurality of injection openings 360 defined therein. Sidewall 350 may have any number of injection openings 360 defined therein that enables fuel nozzle 200 to function as described herein. Each opening 360 is oriented to inject fuel from cavity 250 into mixing tube 320. In the exemplary embodiment, the fuel injected through injection opening 360 mixes with air channeled through a respective mixing tube 320 from upstream opening 330. Accordingly, in the exemplary embodiment, each injection opening 360 divides a respective mixing tube 320 into an upstream portion 370 in which air is channeled therethrough and a downstream portion 380 in which an air-fuel mixture is channeled therethrough.

To facilitate preparing the turbine engine for operation, in the exemplary embodiment, fuel is channeled downstream through center supply tube 280 prior to being channeled radially outward through space 305. As such, in the exemplary embodiment, the fuel flow facilitates convectively cooling aft face 230. The fuel is then channeled radially outward through space 305. More specifically, in the exemplary embodiment, the fuel is channeled radially outward towards heat shield 260 and/or outer sleeve 240 between adjacent mixing tubes 320.

In the exemplary embodiment, fuel is channeled upstream through cavity 250 towards those portions of mixing tubes 320 that are upstream from baffle plate 300. In the exemplary embodiment, the fuel is then channeled through injection openings 360 and into each mixing tube 320, wherein the fuel is mixed with the air channeled through a respective upstream portion 370. The resulting air-fuel mixture is then channeled through downstream portions 380 and discharged into combustion zone 210.

The exemplary methods and systems described herein enable fuel and/or air to be channeled through a fuel nozzle to regulate a temperature of the fuel nozzle. By channeling fuel and/or air downstream through a center supply tube, radially outward between a baffle plate and aft face, and upstream towards an injection opening radially inward of a heat shield, convection cooling of the outer sleeve is reduced, thereby reducing a thermal gradient between the outer sleeve and the aft face. As such, the cooling of the aft face reduces thermal stresses within the fuel nozzle, thereby increasing durability and/or robustness of the fuel nozzle.

The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the invention, including the best mode, and also to enable any person skilled in the art to practice those certain embodiments, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel nozzle comprising:

a forward face;

an aft face downstream from said forward face;

a plurality of mixing tubes extending between said forward face and said aft face, wherein at least one of said plurality of mixing tubes comprises a sidewall that includes an injection opening defined therethrough;

an outer sleeve positioned radially outward of said plurality of mixing tubes;

a heat shield positioned radially inward of said outer sleeve; and a baffle plate between said forward face and said aft face, wherein said baffle plate is oriented to channel fuel between said plurality of mixing tubes and between said baffle plate and said aft face prior to the fuel being channeled through the injection opening.

2. A fuel nozzle in accordance with claim 1 further comprising a supply tube oriented to channel the fuel downstream towards said baffle plate, wherein said supply tube is substantially centered within said fuel nozzle.

3. A fuel nozzle in accordance with claim 1, wherein an annular gap is defined between said outer sleeve and said heat shield.

4. A fuel nozzle in accordance with claim 1, wherein at least one of said outer sleeve and said heat shield is oriented to channel the fuel towards the injection opening.

5. A fuel nozzle in accordance with claim 1, wherein at least one of said outer sleeve and said heat shield is oriented to channel the fuel towards the injection opening.

6. A fuel nozzle in accordance with claim 1, wherein the injection opening is upstream from said baffle plate.

7. A fuel nozzle in accordance with claim 1, wherein the injection opening is oriented to channel the fuel downstream through at least one of said plurality of mixing tubes.

8. A combustor comprising:

a combustor wall defining a combustion zone; and a fuel nozzle comprising a forward face, an aft face downstream from said forward face and adjacent to the combustion zone, a plurality of mixing tubes extending between said forward face and said aft face, an outer sleeve positioned radially outward of said plurality of mixing tubes, a heat shield positioned radially inward of said outer sleeve, and a baffle plate between said forward face and said aft face, wherein at least one of said plurality of mixing tubes comprises a sidewall that includes an injection opening defined therethrough, and wherein said baffle plate is oriented to channel fuel between said plurality of mixing tubes and between said baffle plate and said aft face prior to the fuel being channeled through the injection opening.

9. A combustor in accordance with claim 8, wherein said fuel nozzle further comprises a center supply tube oriented to channel the fuel downstream towards said baffle plate, wherein said supply tube is substantially centered within said fuel nozzle.

10. A combustor in accordance with claim 8, wherein an annular gap is defined between said outer sleeve and said heat shield.

11. A combustor in accordance with claim 8, wherein an insulating mechanism is positioned radially inward of said outer sleeve.

12. A combustor in accordance with claim 8, wherein at least one of said outer sleeve and said heat shield is oriented to channel the fuel towards the injection opening.

13. A combustor in accordance with claim 8, wherein the injection opening is upstream from said baffle plate.

14. A combustor in accordance with claim 8, wherein the injection opening is oriented to channel the fuel downstream through at least one of said plurality of mixing tubes towards the combustion zone.

15. A combustor in accordance with claim 8, wherein said mixing tube sidewall includes a second injection opening defined therethrough.

* * * * *